US006185849B1

(12) United States Patent
Liu

(10) Patent No.: US 6,185,849 B1
(45) Date of Patent: Feb. 13, 2001

(54) CRYSTAL BALL WITH ASSEMBLED MOTIVE DIE SET

(76) Inventor: Jack Liu, No. 3, Alley 202, Kao-Fon Rd., Hsin-Chu City (TW)

( * ) Notice: Under 35 U.S.C. 154(b), the term of this patent shall be extended for 0 days.

(21) Appl. No.: 09/198,347

(22) Filed: Nov. 24, 1998

Related U.S. Application Data

(62) Division of application No. 08/611,668, filed on Mar. 6, 1996, now Pat. No. 5,842,296.

(51) Int. Cl.[7] ..... G09F 19/08
(52) U.S. Cl. ..... 40/411; 40/409; 74/54
(58) Field of Search ..... 40/406, 409, 410, 40/411, 414; 74/54; 446/297; 84/94.1, 94.2, 95.1, 95.2

(56) References Cited

U.S. PATENT DOCUMENTS

| | | | | |
|---|---|---|---|---|
| 4,344,243 | * | 8/1982 | Reszka | 40/414 X |
| 4,983,890 | | 1/1991 | Satoh et al. | 40/414 X |
| 5,040,319 | * | 8/1991 | Wang et al. | 40/414 |
| 5,088,218 | * | 2/1992 | Liu | 40/411 |
| 5,090,144 | * | 2/1992 | Liu | 40/410 |
| 5,134,795 | | 8/1992 | Wang | 40/411 |
| 5,339,923 | | 8/1994 | Chen | 40/411 X |
| 5,412,890 | | 5/1995 | Fechter | 40/414 |
| 5,458,012 | | 10/1995 | Liu | 40/409 X |
| 5,459,278 | | 10/1995 | Hsu | 84/95.1 |
| 5,532,422 | * | 7/1996 | Chang | 84/95.1 |
| 5,584,742 | | 12/1996 | Chen | 84/94.2 X |
| 5,842,296 | * | 12/1998 | Liu | 40/409 X |

* cited by examiner

*Primary Examiner*—Brian K. Green
(74) *Attorney, Agent, or Firm*—Smith Gambrell & Russell, LLP

(57) ABSTRACT

A crystal ball has an assembled motive die set. The crystal ball includes a music box and a driving base, wherein the driving base has a plurality of driven gears which are driven by a center motive gear installed on the base of the driving base. Assembled motive die sets representing different motion types are mounted on the upper cover of the base with respect to the driven gears, and are changeable as desired. The motive die set is influenced by the dynamic force of the music box through the driving base.

10 Claims, 9 Drawing Sheets

CRYSTAL BALL WITH ASSEMBLED MOTIVE DIE SET

This application is a divisional application of U.S. application Ser. No. 08/611,668, now U.S. Pat. No. 5,842,296, filed Mar. 6, 1996, which is relied on and incorporated by reference herein in its entirety.

BACKGROUND OF THE PRESENT INVENTION

The present invention relates to a crystal ball with assembled motive die set, and especially, to a motive die set the elements of which can be assembled and changed, at will so that the interior of the crystal is presented with various dynamic phenomena.

DESCRIPTION OF THE PRIOR ART

The driving device of the crystal ball decorative article with dynamic phenomena of the prior art is basically to drive an interior structure of the crystal ball which is driven to present dynamic phenomenon.

For a further detailed design related to a crystal ball, the driving device drives at least two dynamic structures so that the crystal ball is plentiful of dynamic phenomena.

However, the components of said crystal ball structure are designed for specific dynamic phenomena, thus the components of different types of the crystal ball decorative articles are not adaptive to each other. Therefore, the costs of die sets, stock and management are increased.

SUMMARY OF THE INVENTION

Accordingly, the object of the present invention is to provide a crystal ball with assembled motive die set. A plurality of assembled motive die sets to present various dynamic phenomena are provided on the base and the positions for different motive die sets are changeable so that a plurality of components of crystal ball decorative article with different types, especially the driving substrate, are adaptive to each other. Such an arrangement is more convenient with respect to the assembly of the die set, stock, and management and also cheaper in cost than that of the prior art.

Moreover, because the driving means of the present invention may be assembled with a plurality of motive die sets, the volume of said crystal ball is probably bigger and heavier. When the spring of the music box is wound, the assembled orientation of the music box must be changed, and therefore, a steering means is installed for the user to wind the spring from the side of the crystal ball.

DESCRIPTION OF THE PREFERRED EMBODIMENT

Figure 1:
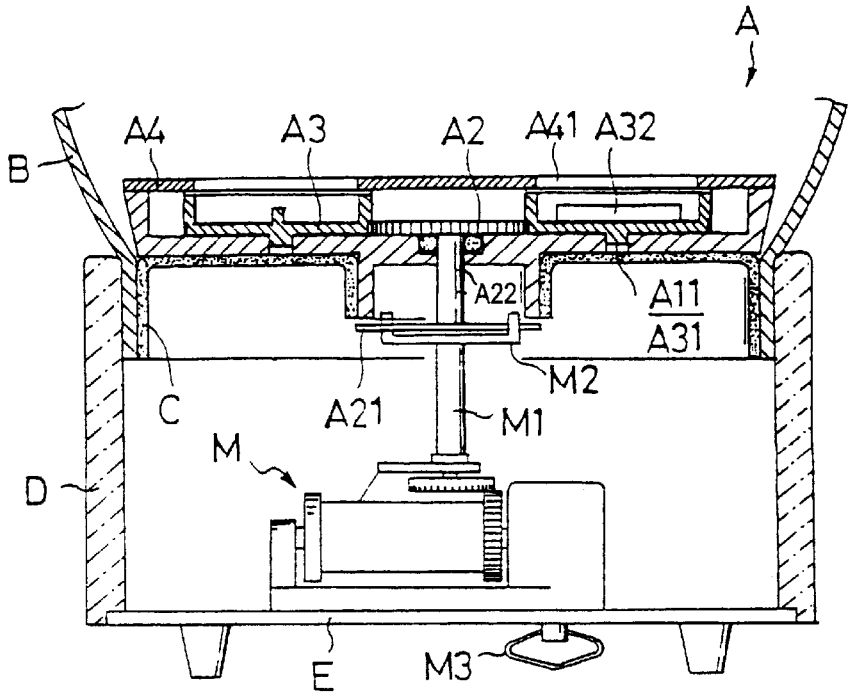
FIG. 1 is a view of the crystal ball which shows the assembled relation of the driving substrate with respect to a rubber stopper, a glass ball and a music box.

The structure of the crystal ball of the present invention contains a driving substrate (A) which is supported and located on the upper surface of the rubber stopper (C) below the glass ball (B) as shown in FIG. 1. Moreover, a music box is installed on the bottom base (E) below the wood base (D), the power is output from the music box through the longitudinal output axle (M1) and an elastic claw (M2).

Figure 3:
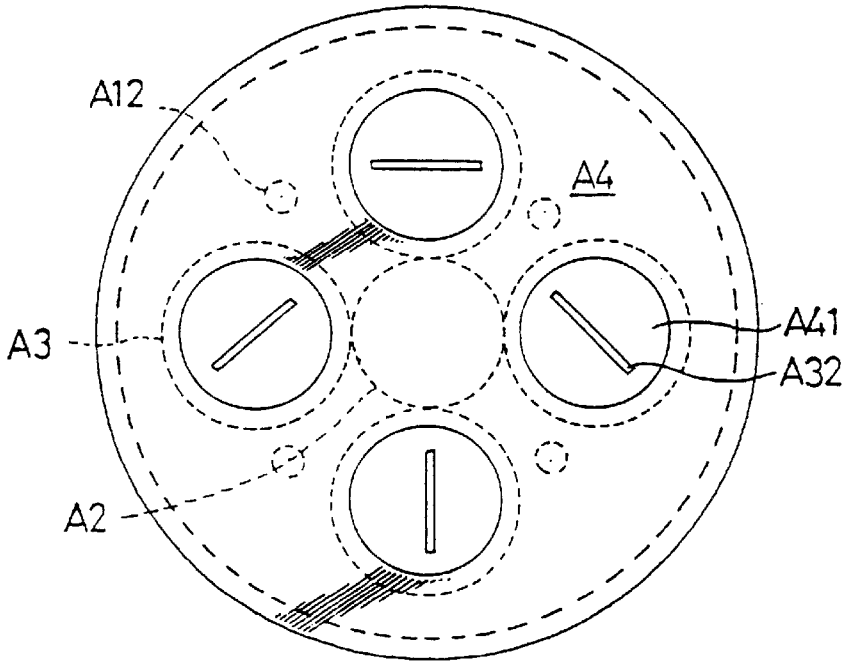
FIG. 3 is the top view of the FIG. 2.
Figure 2:
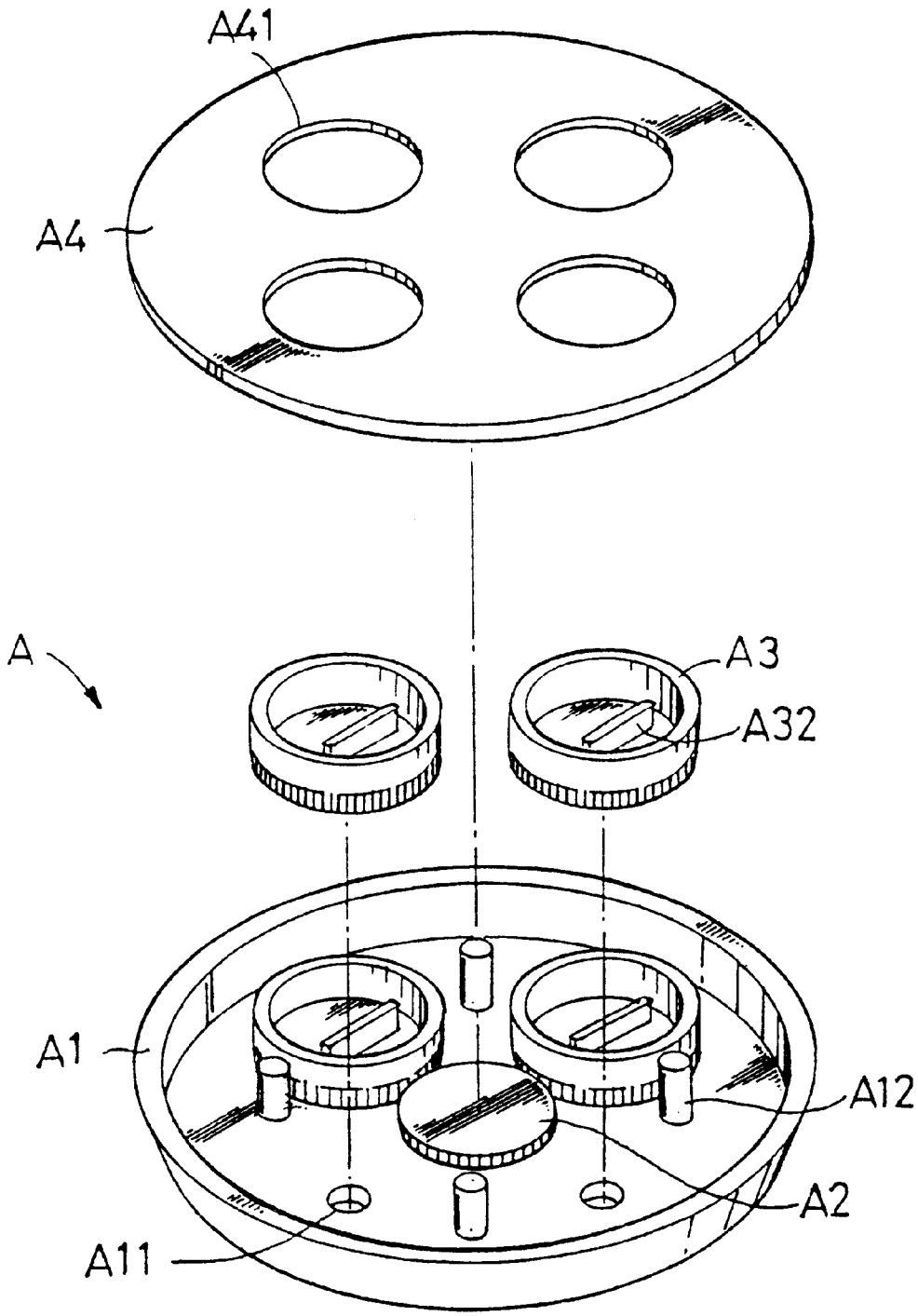
FIG. 2 is a view of the driving substrate of the FIG. 1.

As shown in the FIGS. 2 and 3, said driving substrate of the crystal ball according to the present invention comprises a disk shape base (A1) on the center of which a motive gear (A2) is mounted and about the periphery of which a plurality of driven gears of disk shape mounted with equal spaces and engaged with said motive gear (A2) are installed, said driven gear (A3) forms an axle projection (A31) which is engaged with the axle hole (A11) of the base so that when the motive gear (A2) is driven to rotate through the driven connection link (A21) and the center axle (A22), said driven gear is driven to rotate about the axle projection (A31).

Moreover, a cross separation sheet (A32) is mounted on the proper height of the center of the driven gear (A3).

Further, a top cover (A4) is installed above the bottom base (A1) against the supporting column of the bottom base (A1), and said supporting column is positioned between the adjacent driven gears (A3). A round hole smaller than the inner radius of the driven gears (A3) is formed with respect to the driven gears (A3).

Figure 4:
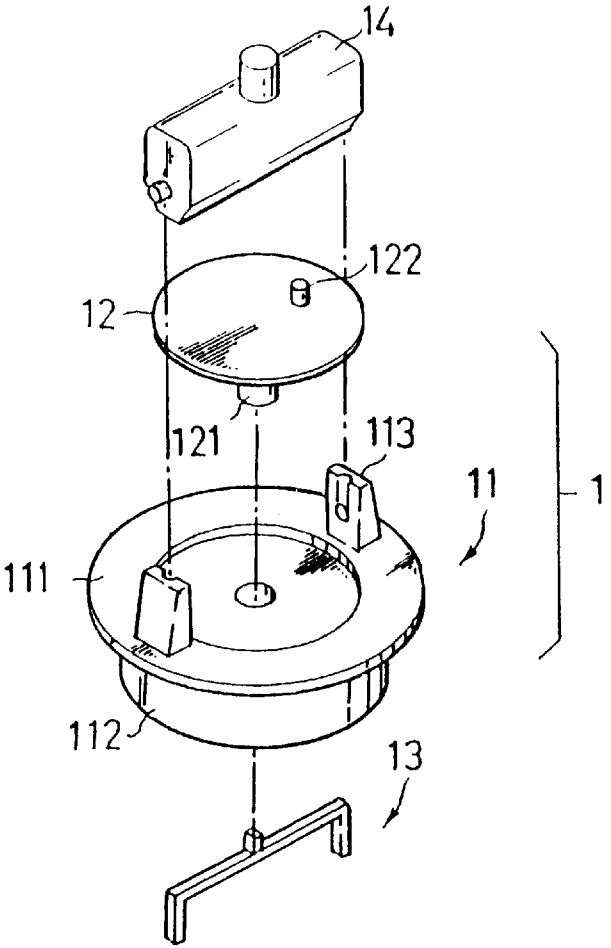
FIG. 4 is the perspective view of the motive die set attached to the driving substrate.

As shown in the FIG. 4, a assembled motive die set (1) comprises an assembled body (11) the diameter of which is larger then the disk surface (111) of the top cover round hole (A41) of the base. The lower part of the body forms a neck part (112) the outer diameter of which is equal to that of the top cover round hole (A41) of the base. Therefore, said body (11) is secured on the top cover (A4) through the tight engagement of the neck part (112) and the top cover round hole (A41).

Also, a rotary disk (12) is installed above the disk surface (111). The axle center (121) of said rotary disk (12) is connected with an elastic claw (13) located on the body neck (112) in order that the rotary disk (12) is driven through the elastic claw (13). Meanwhile, the surface of said rotary disk (12) is installed with an offset pin (122).

A vibrating block (14) is installed above the rotary disk (12) and is retained with a proper distance therewith. The vibrating block (14) is pivotally connected with the supporting wall (113) on the periphery of the disk surface (111), and a long recess (141) is formed under the vibrating block (14) in order to contain said pin (122).

Figure 5:
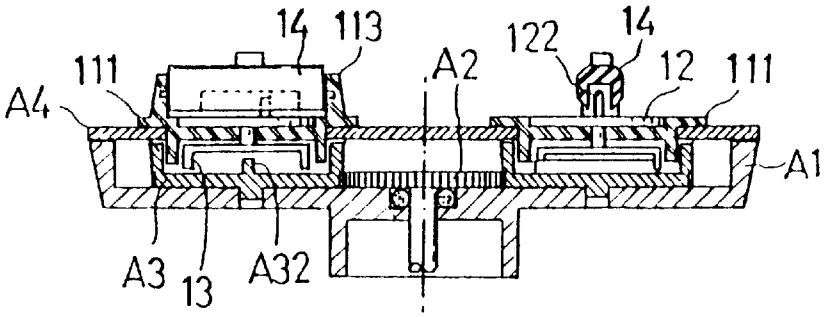
FIG. 5 is the front section view of the motive die set attached to the driving substrate of the FIG. 4.

As shown in FIG. 5, in the assembled motive die set (1), when the neck part (112) is installed on the top cover round hole (A41), the horizontal height of the end part of the elastic claw (13) is within the rotary range of the cross separation sheet (A32) within the driven gear (A3).

Figure 6:
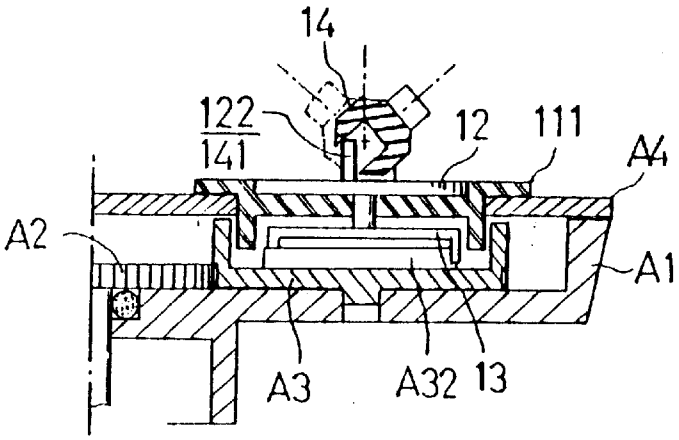
FIG. 6 is a schematic view which presents the longitudinal repeated vibration of a driven motive die set.

The rotation of the elastic claw, i.e., the rotation of the rotary disk of the motive die set, will induce the offset pin (122) of the rotary disk (12) to drive the vibrating block (14) to vibrate, as shown in FIG. 6. If a doll is installed above the vibrating block (14), it will present a dynamic phenomenon of vibrating.

If the structure of the motive die set (1) is simplified and a doll is fixed on the rotary center of the rotary disk (12), the doll will rotate on the original place.

According to the arrangement of said driving substrate (A) and different motive die sets (1), the position of each of the motive die sets (1) can be changed as desired. It is apparent that the motive die set (1) is formed as a type of being conveniently assembled.

The single motive die set (1) described above presents an independently dynamic phenomenon. That shown in FIGS. 7 and 8 is a combined motive die set (2) comprising two sets of assembled bodies (21, 21') and two connection links (24, 24') above the rotary disks (22, 22'), wherein the corresponding ends of the two connection links (24, 24') are pivotally connected with the periphery of the rotary disk (22, 22') at the connecting points (P1, P2), and the adjoined ends of the two connection links (24, 24') are pivotally connected with the connecting point (P).

Figure 7:
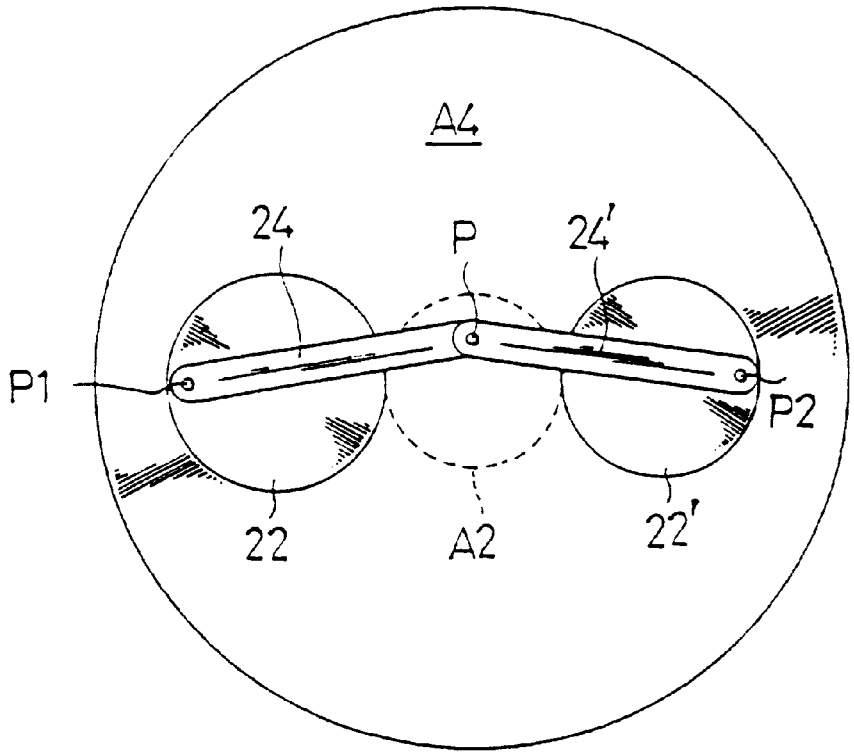
FIG. 7 is the top view for the assembly of a die set on the driving substrate.
Figure 8:
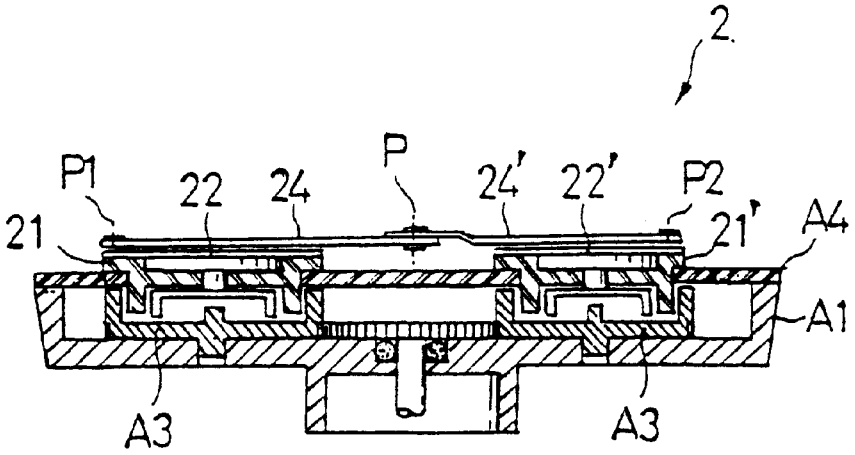
FIG. 8 is the front sectional view of FIG. 7.
Figure 9:
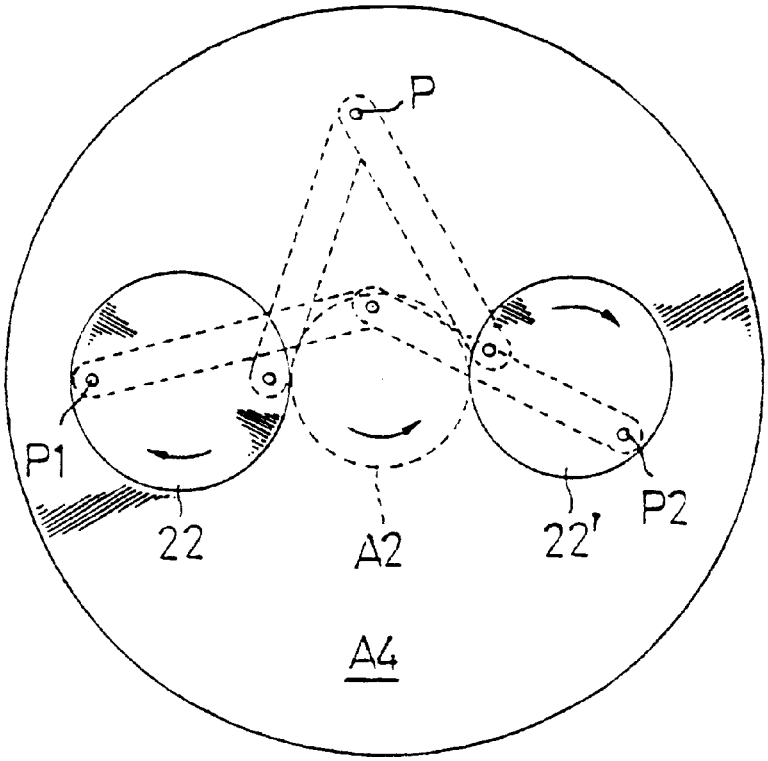
FIG. 9 shows the dynamic state of the driven connection link of the motive die set.

Said connecting points (P1, P2) may be installed on the non symmetric positions of the rotary disk, for example, a farther opposing end or a near opposing end, as shown in FIG. 7. Therefore, when the motive gear (A2) drives the driven gears (A3) for the rotary disks (22, 22') to rotate in the same orientation, the angle between the connection links (24, 24') will also change, i.e. the position of the connection point (P) is changed, as shown in the FIG. 9. If a doll is installed on the point (P), then it will present a specific dynamic phenomena.

If the two driven gears (A3, A3') for rotating the rotary disks (22, 22') have the same diameters, the motions of said two connection links (24, 24') are regular. On the other hand, if the two driven gears (A3, A3') have different diameters, the positions of the connection point (P) of the connection links (24, 24') may have various irregular states, as shown in the FIG. 9.

Figure 10:
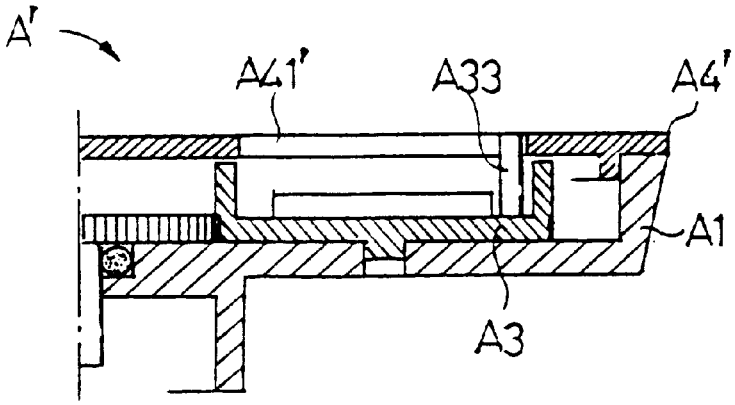
FIG. 10 is a modified embodiment of a driving substrate.
Figure 11:
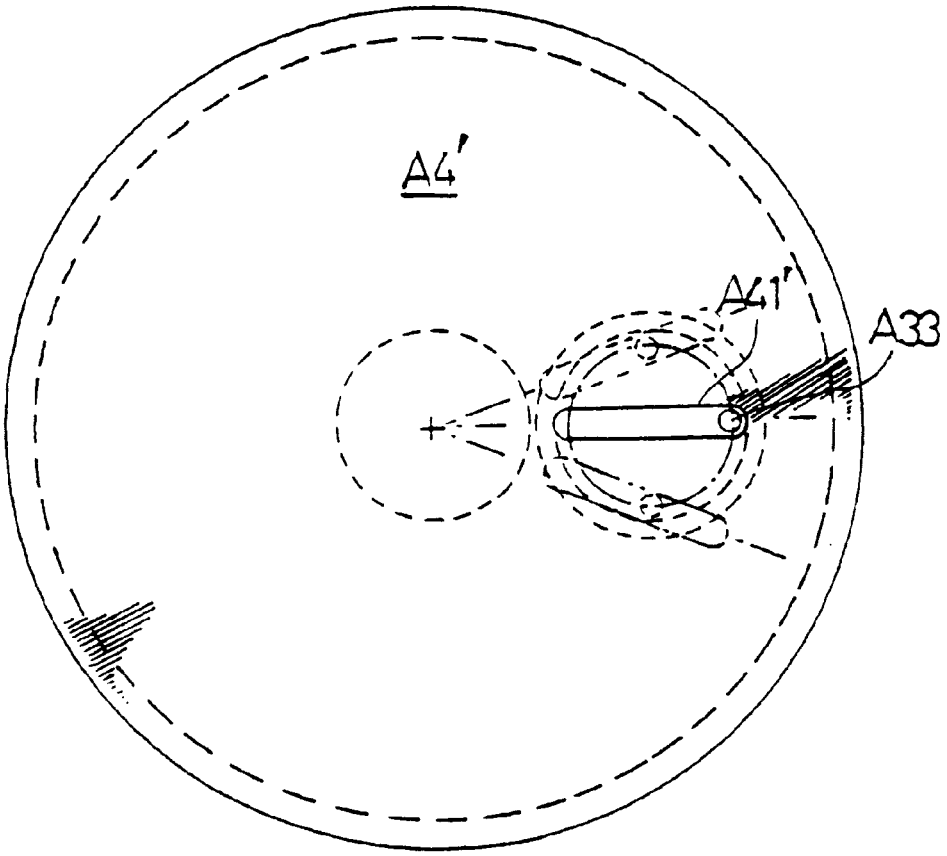
FIG. 11 is the top view of FIG. 10, it represents an axial repeated motion of a driven top cover of the driving substrate.

The upper cover of said driving substrate (A) having motive die set (1) is stationarily fixed above the base (A1), and presents dynamic phenomena which is different from that of said motive die set (1). Shown in the FIGS. 10 and 11 is another structure of driving substrate (A'), basically the driving substrate (A') only have a driven gear (A3) engaging with the center motive gear (A2). The offset position of the driven gear (A3) is installed with a longitudinal column (A33) and the upper cover (A4') with respect to the base (A1) is in the state of being freely rotating. A radial long hole (A41') installed on the upper cover (A4') with respect to the inner diameter of the driven gear (A3). Said longitudinal column (A33) is penetrated through the long hole (A41').

According to the structure of said driving substrate (A'), when the driven gear (A3) is similarly driven to rotate, the longitudinal column (A33) on the upper cover long hole (A41') will drive the upper cover (A4') through the long hole (A41') so to present a repeated vibration of the rotary diameter of the longitudinal column (A33). If a doll is installed above the upper surface of the upper cover (A4'), it may present various different dynamic phenomena which are different from said motive die set (1).

Figure 12:
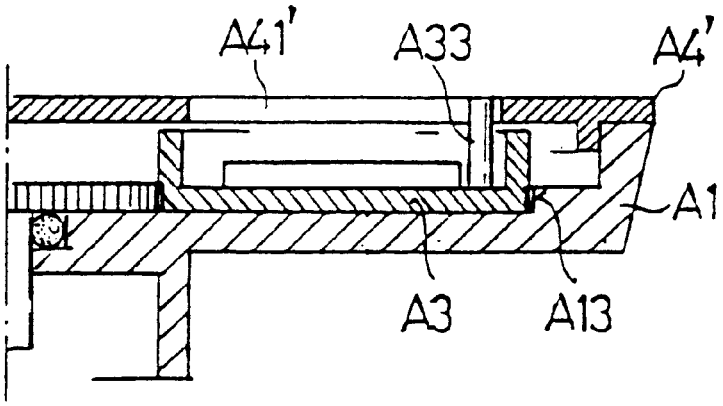
FIG. 12 is a modified embodiment of the FIG. 10.

The driven gear (A3) of said structure is in the state of revolution, if the inner periphery of the base (A1) is installed with a circular toothed strip (A12) engaged with the driven gear (A3), as shown in FIG. 12, then said driven gear (A3) presents a state of revolution and spin with respect to said upper cover (A4') according to the functions of the motive gear (A2) and the circular gear (A12) and also rotates according to the trace of the motion of the longitudinal column (A33).

Figure 13:
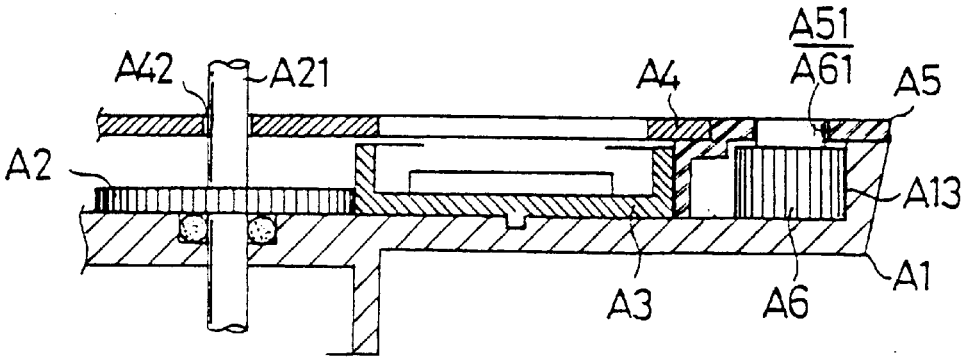
FIG. 13 is another modified embodiment.

In order that the present invention is plentiful of dynamic phenomena, as shown in the FIG. 13, a circular rotary cover is installed between the external portion of the upper cover (A4) and the outer rim of the bottom base (A1). The inner rim of the rotary cover (A5) is engaged with the driven gears (A3), so that the rotary cover (A5) is driven by the driven gears (A3). Furthermore, since a gear which is engaged with circular rack (A13) on the inner side wall of the bottom base (A1), so that a convex column (A61) is projected through a round hole (A51) of the rotary cover (A5), the gears (A6) form a revolution condition due to the rotation of the rotary cover (A5) through the convex column (A61), and since the gear (A6) is engaged with the circular gears (A13) so the gear (A6) presents a dynamic phenomenon of spin, that is to say, the doll installed on the convex column (A61) presents the dynamic phenomenon of spin and revolution.

Moreover, a rotary axle (A21) through the penetrated hole (A42) of the upper cover is extended in the longitudinal direction from the upper side of the centered gear (A2), so that when the centered gear (A2) is rotated, the doll on the rotary axle (A21) present a dynamic phenomenon with synchronous rotation.

The music box (M) on the bottom base (E) is located transversely as shown in the FIG. 1, therefore the rotary button (M3) for winding the spring is formed below the bottom base (E). The crystal ball needs to be lifted upward as a whole for operating the rotary button (M3). In order to remedy the defect of such designs, said music box (M) is installed longitudinally, thus the rotary button (M3) is located beside the wood base (D). Therefore, it is not necessary to lift the crystal ball for operating the button (M3) as shown in the FIG. 14.

Figure 15:
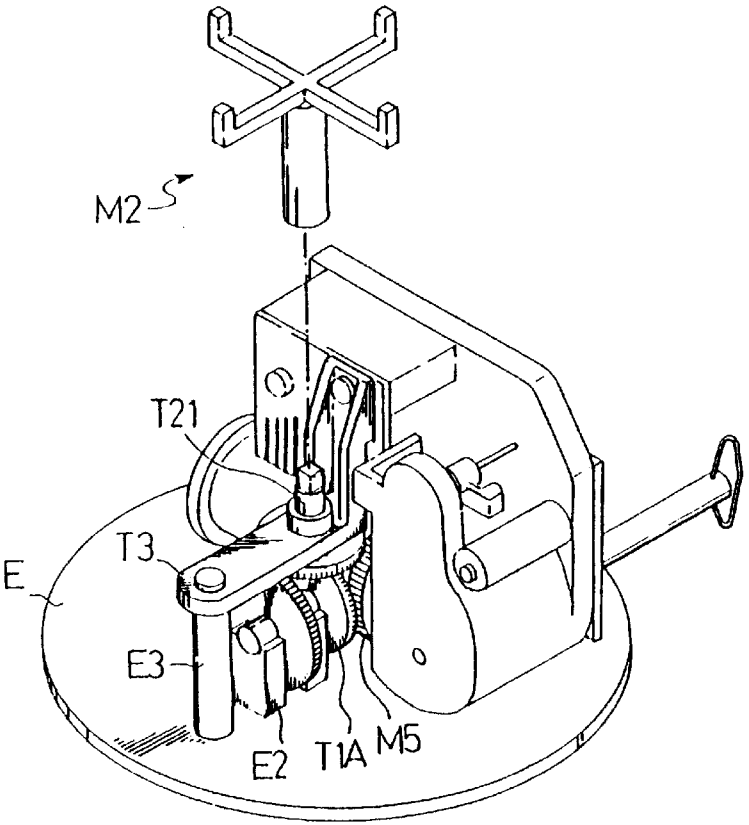
FIG. 15 is a perspective view of FIG. 14.
Figure 16:
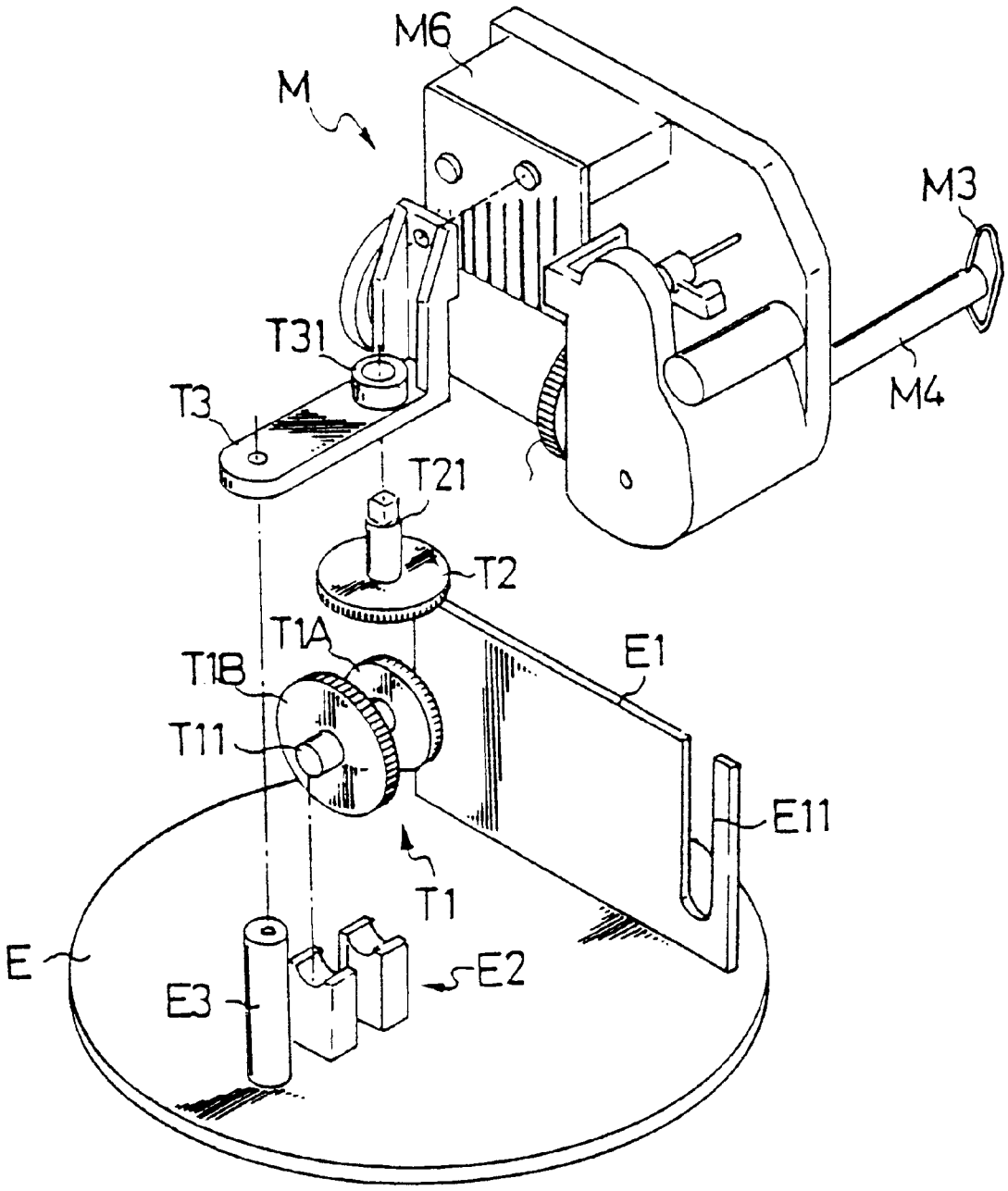
FIG. 16 is an exploded view of the left side of the crystal ball adaptive for the music box of FIG. 14 and the steering means.

For fixing said music box (M) in the longitudinal direction, a longitudinal supporting board (E1) is installed on the bottom base (E) for fixing the music box (M), as shown in FIGS. 15 and 16. A notch (E11) is formed on the supporting board (E1) with respect to the spring axle (M4) of the music box (M). When the music box (M) is assembled in the supporting board (E1) for positioning, said spring axle (M4) can be extended horizontally through the penetrating hole (D1) of the wood base (D) so as to project outside of the wood base (D).

In order that the power of said music box (M) is transmitted to said driving base (A), a steering means (T) is installed on the side face of the music box (M) above the bottom base (E). Said steering means (T) contains a pair of longitudinal gears (T1A, T1B), the axle center (T11) of which is supported by the frame (E2) of the bottom base (E), wherein the longitudinal gear (T1A) is engaged with the gears (M5) of the music box (M).

Also, a crown gear (T2) which is supported by the axle housing (T31) of a frame (T3) is installed above the longitudinal gears (T1A, T1B) and the crown gear (t2) is engaged with the longitudinal gear (T1B). Therefore, when the longitudinal gear (T1B) is driven to rotate by the gear (M5) of the music box (M), the crown gear is also rotated synchronously. The frame (T3) for supporting the crown gear (T2) has the shape of an L, one side of which is fixed on the side face of the base (M6) of the music base (M), and the other side is fixed on the supporting column (E3) of the bottom base (E).

As shown in the figures, an elastic claw (M2) can be engaged on the upper end of the wheel axle (T21) of the steering means (T2), so that the motive gear (A2) is driven to rotate by the elastic claw (M2) through the driving lever.

Figure 14:
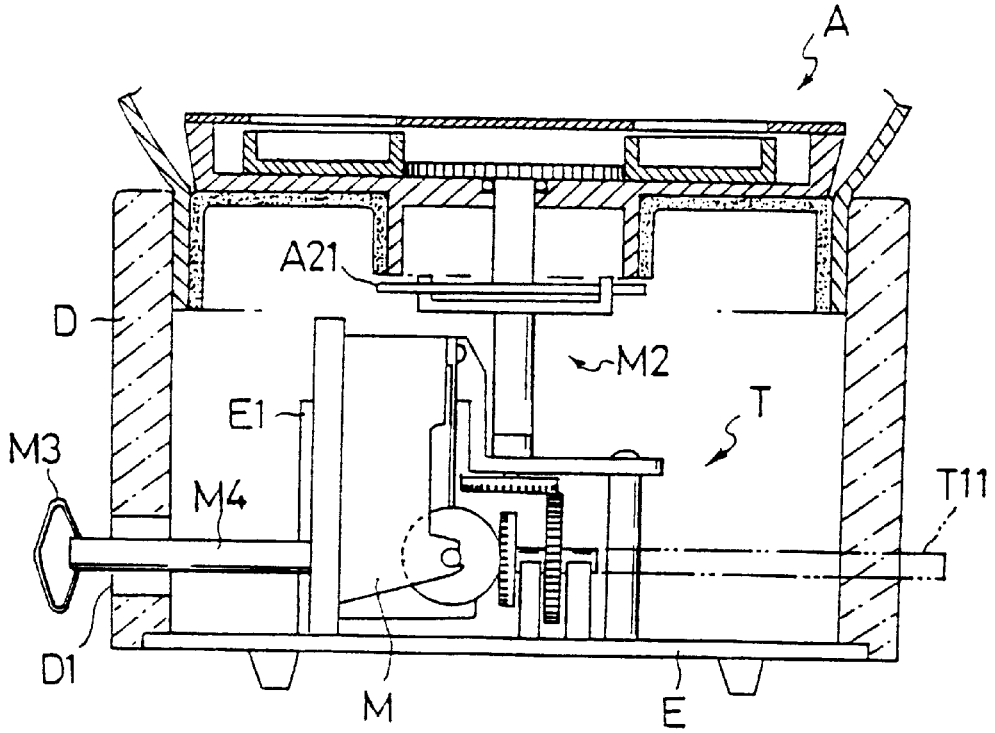
FIG. 14 is a modified embodiment of the power output of the music box, which represents the view of the position relation between the longitudinal music box and the steering means.
Figure 17:
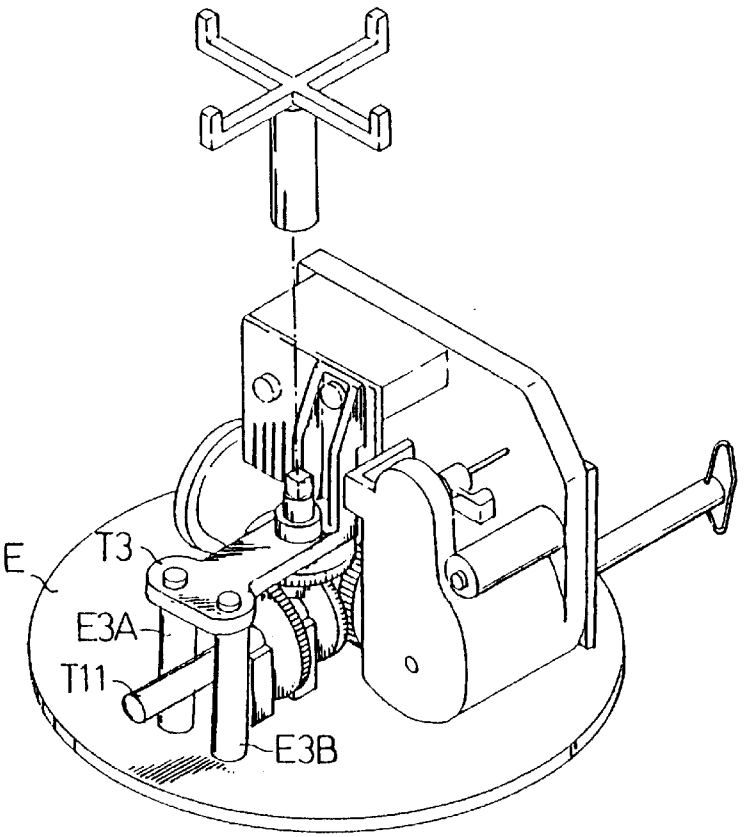
FIG. 17 shows a modified embodiment of the steering means of FIG. 15.

FIG. 17 shows a modified embodiment of said steering means (T), wherein one end of the frame (T3) is supported by two supporting columns (E3A, E3B) the gap between which is larger than the diameter of the axle center (T11) of the gear (T1), thus the axle (T11) is extended outward to the outside of the wood base (D) through the supporting column (E3), as shown in the imaginary line of the FIG. 14, so that the doll on the end of the axle center (T11) presents a rotation phenomenon.

What is claimed is:

1. A crystal ball with an assembled motive die set, comprising:

a music box;

a driving substrate, a portion of which is rotatably connected with the music box by a longitudinal output axle, the driving substrate comprising:

a disk shaped base portion, having an annular raised portion on an outer periphery thereof, a motive gear, mounted in a center of the disk shaped base portion, operably connected to the longitudinal output axle so as to rotate the motive gear, at least one driven gear, provided on the disk shaped base portion, each driven gear driven to rotate by force provided from the motive gear, and an upper cover, fixed to the annular raised portion of the disk shaped base portion, said upper cover including at least one driven gear opening corresponding to a position of one of the driven gears; and at least one assembled motive die set, provided on the upper cover of the driving substrate, and driven by one of the driven gears of the driving substrate, wherein one of the motive die sets comprises:

a die set body, having an upper disk face, a lower neck portion, and an opening defined therethrough, a rotary disk, and a claw member, wherein the lower neck portion of the die set body is positioned within one of the driven gear openings of the upper cover of the driving substrate, and wherein the rotary disk is fixed to the claw member through the opening of the die set body so that the rotary disk is disposed above the upper disk face of the die set body and rotates concurrently with the claw member with respect to the die set body, the claw member being, in turn, rotatably engaged with one of the driven gears.

2. The crystal ball according to claim 1, wherein a periphery of at least one of the motive die sets includes a plurality of driven gears.

3. The crystal ball according to claim 1, wherein the crystal ball includes two motive die sets and two connecting links positioned above the rotary disks of the die sets, each of the connecting links being pivotally attached at one end to a periphery of one of the rotary disks at a connecting point, and each of the connecting links being pivotally connected at a second end of the connecting links to each other.

4. The crystal ball according to claim 1, further comprising a geared circular rotary cover, positioned between an outer portion of the upper cover and the annular raised portion of the disk shape base portion, the geared circular rotary cover having an inner rim engaged with the driven gears.

5. The crystal ball according to claim 4, further comprising a peripheral gear, rotatably engaged with a circular rack of an inner face of the disk shaped base portion, the peripheral gear having a column thereon which projects through a hole defined in the upper cover.

6. A driving substrate of a crystal ball, comprising:

a base portion, having a center axle opening and at least one axle hole defined therein;

a cover portion, mounted so as to freely rotate, having at least one radial elongated hole therethrough;

a motive gear, having a disk shaped portion and a center axle portion, the motive gear being rotatably engaged with a rotating means, the center axle portion being positioned in the center axle opening of the base portion; and at least one driven gear, rotatably engaged with the motive gear, the driven gear having a disk shaped portion and an axle projection on a lower face thereof, the axle projection being positioned in the axle hole of the base portion, wherein the at least one driven gear is provided with a longitudinal column provided in an offset position on an upper face of said driven gear, and wherein the longitudinal column projects through the radial elongated hole of the cover portion, so that as the driven gear is rotated, the cover portion is driven to rotate in a first direction, and then in a second direction, in alternating fashion.

7. The driving substrate of a crystal ball according to claim 6 wherein a plurality of driven gears are provided, wherein one driven gear lacks an axle projection, and wherein the driven gears rotatably engage with a circular toothed strip in an inner periphery of an outer annular portion of the base portion.

8. A motive die set assembly, comprising:

a cylindrical die set body having a neck portion and an upper portion, said upper portion being above said neck portion and at least a part of said upper portion extending outwardly beyond said neck portion, said body having an opening defined therethrough;

a rotary disk member disposed within said upper portion of the cylindrical die set body, said rotary disk member having a pin member extending therefrom which is disposed at a location offset from a center of said rotary member;

a claw member, said rotary member being coupled with said claw member through said opening in said body such that said rotary member is rotated relative to said body when said claw member is rotated relative to said body; and a vibrating block, defining a pin engagement opening, the pin member extending from said rotary member being received in said pin engagement opening, wherein said upper portion of said body includes a pair of supporting walls extending therefrom, said vibrating block being supported by said supporting walls.

9. The motive die set assembly according to claim 8, wherein said vibrating block is pivotally coupled to said supporting walls.

10. The motive set assembly according to claim 9, wherein when said rotary member is rotated, said pin remains received in said pin engagement opening, thereby causing said vibrating block to pivot in a reciprocating manner.

* * * * *